US006946232B2

(12) United States Patent
Gomes et al.

(10) Patent No.: US 6,946,232 B2
(45) Date of Patent: Sep. 20, 2005

(54) IMAGE-RECEIVING ELEMENT

(75) Inventors: Gerard Gomes, West Boylston, MA (US); Gary S. LaPointe, Beverly, MA (US); James J. Manning, Braintree, MA (US)

(73) Assignee: Polaroid Corporation, Waltham, MA (US)

( * ) Notice: Subject to any disclaimer, the term of this patent is extended or adjusted under 35 U.S.C. 154(b) by 44 days.

(21) Appl. No.: 10/715,802

(22) Filed: Nov. 17, 2003

(65) Prior Publication Data

US 2005/0106484 A1 May 19, 2005

(51) Int. Cl.[7] ..... G03C 8/24; G03C 8/50; G03C 8/52; G03C 1/805

(52) U.S. Cl. ..... 430/203; 430/215; 430/227; 430/263

(58) Field of Search ..... 430/203, 215, 430/227, 263

(56) References Cited

U.S. PATENT DOCUMENTS 3,674,482 A 7/1972 Haberlin ..... 96/29
3,816,125 A * 6/1974 December et al. ..... 430/218
3,844,789 A 10/1974 Bates et al. ..... 96/68
4,009,031 A * 2/1977 Carlson et al. ..... 430/213
4,629,677 A 12/1986 Katoh ..... 430/215
4,871,648 A 10/1989 Bowman et al. ..... 430/215
4,954,419 A 9/1990 Shinagawa et al. ..... 430/215
5,346,800 A 9/1994 Foley et al. ..... 430/213
5,591,560 A 1/1997 Fehervari et al. ..... 430/203
6,403,278 B1 * 6/2002 Fehervari et al. ..... 430/203

* cited by examiner

*Primary Examiner*—Richard L. Schilling

(57) ABSTRACT

An image-receiving element for use in photographic and photothermographic diffusion transfer film units of the type where the image-receiving element is designed to be removed, or "peeled-apart" from a photosensitive element following exposure and photographic processing. The present image-receiving element comprises, in sequence, a support, an image-receiving layer and a strip-coat layer which serves to facilitate separation of the image-receiving element from the photosensitive element after photographic processing. The strip-coat layer comprises an anion of poly(acrylic acid), or a salt thereof, complexed with a cationic quaternary salt. In a preferred embodiment, the strip coat layer may include an ethoxylated alcohol.

14 Claims, 1 Drawing Sheet

IMAGE-RECEIVING ELEMENT

BACKGROUND OF THE INVENTION

This invention relates to an image-receiving element for use in photographic and photothermographic film units of the diffusion transfer type. More particularly, the invention relates to an image-receiving element especially adapted for use in diffusion transfer film units wherein an image-receiving element is designed to be separated from a photosensitive element after exposure and processing.

Photographic film units of this type are well known and are often referred to as "peel apart" photographic film units. Various embodiments of peel-apart film units are known and include those wherein images are formed in black and white (reduced silver), and color (image dyes), as described in: E. H. Land, H. G. Rogers, and V. K. Walworth, in J. M. Sturge, ed., *Neblette's Handbook of Photography and Reprography,* 7th ed., Van Nostrand Reinhold, New York, 1977, pp. 258–330; and V. K. Walworth and S. H. Mervis, in J. Sturge, V. Walworth, and A. Shepp, eds., *Imaging Processes and Materials: Neblette's Eighth Edition*, Van Nostrand Reinhold, New York, 1989, pp. 181–225. Additional examples of peel apart film units are described in U.S. Pat. Nos. 2,983,606; 3,345,163; 3,362,819; 3,594,164; and 3,594,165.

In general, diffusion transfer photographic products and processes involve film units having a photosensitive element including a support carrying at least one silver halide emulsion, and an image-receiving element including a support and an image-receiving layer. After photoexposure, the photosensitive element is developed, typically by uniformly distributing an aqueous alkaline processing composition over the photoexposed element, to establish an imagewise distribution of a diffusible image-providing material. The image-providing material, (e.g. image dyes or complexed silver), is selectively transferred, at least in part, by diffusion to the image-receiving layer positioned in a superposed relationship with the developed photosensitive element. The image-receiving layer is capable of mordanting or otherwise fixing the image-providing material and retains the transferred image for viewing. The image is viewed in the image-receiving layer upon separation of the image-receiving element from the photosensitive element after a suitable imbibition period. Black and white transfer images are generally formed by exposing and developing a silver halide emulsion, and subsequently dissolving and transferring silver from unexposed, or less exposed regions, to an image-receiving layer containing silver precipitating agents or nuclei. The transferred silver is reduced to metallic silver in the image-receiving layer, thus forming an image. Color images are generally formed by the imagewise transfer of image dyes from a photosensitive element to an image-receiving layer containing a dye mordant material.

Image-receiving elements particularly adapted for use in peel-apart diffusion transfer film units include an image-receiving layer for retaining the transferred image. This image-receiving layer is typically arranged on a substrate layer of suitable material or a combination of layers arranged on the substrate layer. In one well known photographic embodiment, the image-receiving element comprises a support material (preferably, an opaque support material carrying a light-reflecting layer for the viewing of the desired transfer image thereagainst by reflection); a polymeric acid-reacting (neutralizing) layer adapted to lower the environmental pH of the film unit subsequent to substantial transfer image formation; a spacer or timing layer adapted to slow the diffusion of the alkali of an aqueous alkaline processing composition toward the polymeric neutralizing layer; and an image-receiving layer to receive the transferred photographic image. Such a structure is described, for example, in the aforementioned U.S. Pat. No. 3,362,819 and is illustrated in other patents, including U.S. Pat. Nos. 4,322,489 and 4,547,451.

Photothermographic film products for use in diffusion transfer type processes are also well known in the art. Various embodiments of such film products are known and typically comprise: 1) a photosensitive element including at least one photosensitive silver halide-emulsion and a corresponding image providing-material (e.g. silver for black and white embodiments, image dyes for color embodiments), and 2) an image-receiving element including an image receiving layer. Typically, the photosensitive element is exposed and subsequently brought in superposed contact with the image-receiving element, wherein the assembly is heated for a predetermined time period. In addition to heating, some applications require a small amount of water to be added to the photosensitive element prior to lamination with the image-receiving element. The application of heat, (and water if used), results in the image-wise diffusion of image materials from the photosensitive element, to the image-receiving element. Subsequently, the image-receiving element is separated from the photosensitive element. Various embodiments of photothermographic film units and processes are described in: S. H. Mervis and V. K. Walworth, *Kirk-Othmer Encyclopedia of Chemical Technology,* 4th. Edition, Volume 6, John Wiley & Sons, Inc. 1993, pp. 1036–1039. Specific examples of such film units are described in U.S. Pat. Nos.: 4,631,251; 4,650,748; 4,656,124; 4,704,345; 4,975,361; and 5,223,387.

In both photographic and photothermographic film units, a strip-coat (also referred to as a "stripping layer" or "release layer"), is commonly positioned between the photosensitive element and the image-receiving element to facilitate the separation of the elements from one another after processing. In photographic applications, strip-coats may additionally serve to prevent processing solution from remaining on the image-receiving element after processing. A specific example of such a strip-coat is provided in U.S. Pat. No. 5,346,800 to Foley et al. which describes a strip-coat comprising a hydrophilic colloid, e.g. gum arabic, and an aluminum salt. Other materials are also known for use in strip-coat layers. For example: U.S. Pat. No. 3,674,482 to R. J. Haberlin discloses a strip-coat made of a methyl acrylate/acrylic acid copolymer. U.S. Pat. No. 3,844,789 to Bates et al. discloses a strip-coat prepared from PVP (polyvinyl pyrrolidone). U.S. Pat. No. 4,954,419 to Shinagawa et al. discloses a multi-layer strip-coat including a first a peeling layer containing a copolymer of at least (i) an ethylenically unsaturated monomer containing at least one hydrocarbon group containing from 7 to 18 carbon atoms and (ii) an ethylenically unsaturated monomer, the homopolymer of which is soluble in water or an aqueous alkaline solution. With regard to the monomers which are described as being soluble in water or aqueous alkaline solutions, acrylic acid and vinyl pyrrolidone are listed. It is further disclosed that these constituents may be used either alone in combination.

U.S. Pat. No. 5,591,560 discloses an image-receiving element wherein the strip-coat layer comprises a copolymer including monomer units derived from an ethylenically unsaturated carboxylic acid or salt thereof, monomer units of vinyl pyrolidone and monomer units of a methacrylate.

Materials used in strip-coats may be crosslinked. For example, U.S. Pat. No. 4,629,677 to Katoh discloses a strip-coat comprising a crosslinked copolymer containing more than 40 mole % of a monomer unit derived from an ethylenically unsaturated carboxylic acid or a salt thereof. A specific copolymer disclosed includes a copolymer of acrylic acid and hydroxyethyl methacrylate, (see formula 7 in column 7).

U.S. Pat. No. 4,871,648 to Bowman et al. discloses a strip-coat comprising a copolymer including: (i) one or more randomly recurring units of N-alkyl or N,N-dialkylacrylamides; and optionally, (ii) one or more randomly recurring units of nonionic alkyl-, hydroxyalkyl- (e.g. 2-hydroxyethyl acrylate), or oxaalkyl-acrylate or methacrylate monomers, or a carboxylic acid group containing monomer; (e.g. acrylic acid); and optionally , (iii) one or more randomly recurring units of polymerized cross-linking monomers having two or more polymerizable groups.

Some strip-coats may produce a noticeable haze over the image-receiving element upon processing and separation from the photosensitive element. It is known that reducing the thickness of the strip-coat will provide some reduction in haze. Such a reduction in the thickness of the strip coat may provide other benefits as well, e.g. an increase in dye transfer through the strip coat. However, a drawback to providing progressively thinner strip-coats is a reduced effectiveness in facilitating separation between the photosensitive element and the image receiving element. Furthermore, in photographic embodiments, processing composition often remains adhered to thinner strip-coats after processing and separation from the photosensitive element, thus detracting from the quality of the resulting image. Thus, it is desired to provide a relatively thin strip-coat with low haze which can still effectively facilitate separation between the photosensitive element and the image-receiving element. Furthermore, it is desired to provide such a strip-coat having desirable gloss properties.

SUMMARY OF THE INVENTION

The present invention is directed to an image-receiving element for use in photographic and photothermographic film units of the diffusion transfer type comprising, in sequence, a support, an image-receiving layer and a strip-coat layer. The strip coat layer comprises an anion of poly(acrylic acid), or salts thereof, represented by the formula

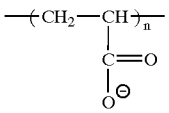

(I)

where n is an integer of from about 65 to about 3500 complexed with a cationic quaternary salt represented by the formula

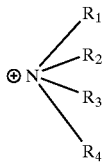

wherein $R_1$–$R_4$ are each independently selected from the group consisting of hydrogen, $C_1$–$C_6$ alkyl and $-(CH_2)_m R_5$ wherein m is 1 or 2 and $R_5$ is phenyl.

The cationic quaternary salt also may have associated with it a photographically acceptable anion which may be a halogen such as chlorine or bromine or tosylate.

Preferred quaternary salts for use according to the invention are ammonium chloride, benzyl trimethyl ammonium chloride, benzyl trimethyl ammonium bromide, benzyl triethyl ammonium chloride and benzyl triethyl ammonium bromide.

Typically, the poly(acrylic acid) has a molecular weight in the range of from about 5,000 to about 250,000 and, preferably, about 50,000. Blends of poly(acrylic acid) of different molecular weights can be used.

Generally, the strip-coat composition comprises a ratio of from about 5:1 to about 1:1 parts by weight of poly(acrylic acid) to the quaternary salt.

In a preferred embodiment the strip coat layer of the invention also includes an ethoxylated alcohol represented by the formula

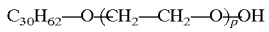

where p is an integer of about 40. It has been found that the presence of the ethoxylated polymer further protects the assembled film pack from undesirable bonding of the mask element to the surface of the image-receiving element at high humidity.

Generally the ethoxylated polymer is present in an amount of from about 10 to about 40 parts by weight to from about 60 to about 90 parts by weight of poly(acrylic acid) and quaternary.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DETAILED DESCRIPTION OF THE PREFERRED EMBODIMENTS

As stated above, the present invention relates to an image-receiving element for use in photographic and photothermographic film units of the diffusion transfer type. More particularly, the present invention is directed toward such film units wherein the image-receiving element is designed to be separated from the photosensitive element after processing. As will be described in detail below, the subject image-receiving element comprises in sequence, a support, an image-receiving layer, and a strip-coat. For purposes of description, a preferred photographic embodiment of the subject image-receiving element will be described in detail below. Those skilled in the art will appreciate that the present invention may be used in other embodiments, including photothermographic film units.

Figure 1:
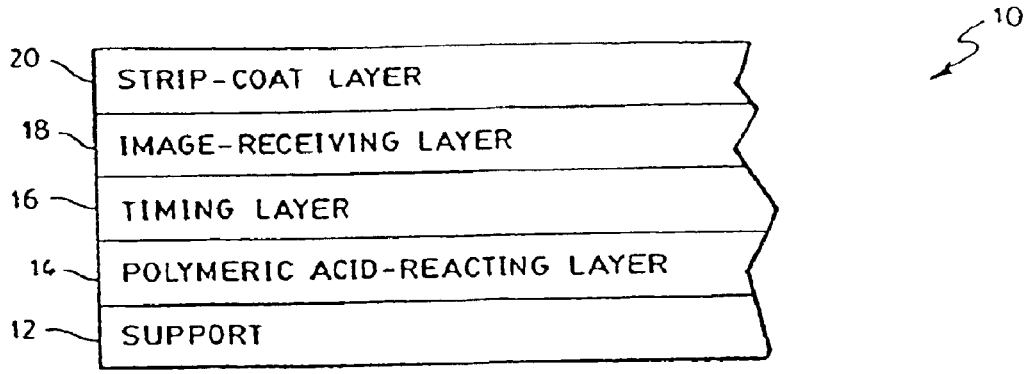
FIG. 1 is a partially schematic, cross-sectional view of one embodiment of an image-receiving element according to the invention.

With reference to FIG. 1, an image-receiving element specifically adapted for use in a photographic peel-apart film unit is generally shown at 10 comprising a support 12 carrying a polymeric acid-reacting layer 14, a timing (or spacer) layer 16, an image-receiving layer 18 and a strip-coat layer 20. Each of the layers carried by support 12 functions in a predetermined manner to provide desired diffusion transfer processing and is described in detail hereinafter. It is to be understood that the image-receiving element of the present invention may include additional layers as is known in the art.

Support material 12 can comprise any of a variety of materials capable of carrying layers 14, 16, 18, and 20, as shown in FIG. 1. Paper, vinyl chloride polymers, polyamides such as nylon, polyesters such as polyethylene terephthalate, or cellulose derivatives such as cellulose acetate or cellulose acetate-butyrate, can be suitably employed. Depending upon the desired nature of the finished photograph, support material 12 may be transparent, opaque or translucent. Typically, an image-receiving element adapted to be used in peel-apart diffusion transfer film units and designed to be separated after processing will be based upon an opaque support material 12. While support material 12 of image-receiving element 10 will preferably be an opaque material for production of a photographic reflection print, it will be appreciated that support 12 will be a transparent support material where the processing of a photographic transparency is desired. In one embodiment where support material 12 is a transparent sheet material, an opaque sheet (not shown), preferably pressure-sensitive, can be applied over the transparent support to permit in-light development.

Figure 2:
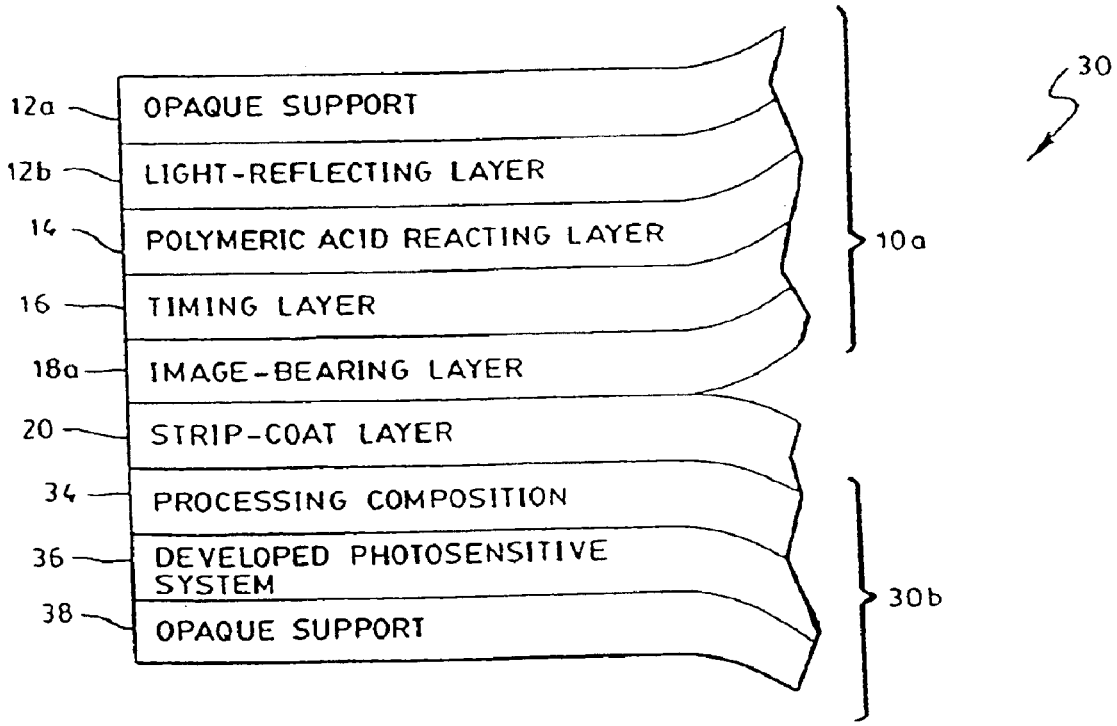
FIG. 2 is a partially schematic, cross-sectional view of a photographic film unit according to the invention, shown after exposure and processing.

In the embodiments illustrated in FIGS. 1 and 2, the image-receiving element 10, 10*a* includes a polymeric acid-reacting layer 14, timing layer 16 and image-receiving layer 18. The polymeric acid-reacting layer 14 reduces the environmental pH of the film unit, subsequent to transfer image formation. As disclosed, for example, in the previously referenced U.S. Pat. No. 3,362,819, the polymeric acid-reacting layer may comprise a nondiffusible acid-reacting reagent adapted to lower the pH from the first (high) pH of the processing composition in which the image material (e.g. image dyes) is diffusible to a second (lower) pH at which they are not diffusible. The acid-reacting polymer is preferably a polymer which contains acid groups, e.g., carboxylic acid or sulfonic acid groups, which are capable of forming salts with alkaline metals or with organic bases, or potentially acid-yielding-groups such as anhydrides or lactones. Thus, reduction in the environmental pH of the film unit is achieved by the conduct of a neutralization reaction between the alkali provided by the processing composition and layer 14 which comprises immobilized acid-reactive sites and which functions as a neutralization layer.

The timing layer 16 controls the initiation and the rate of capture of alkali by the acid-reacting layer 14 and can operate in a number of ways as has been described in the art. The image-receiving layer 18 is designed for receiving an image-forming material which diffuses in an imagewise manner from the photosensitive element during processing. In a preferred embodiment of the invention, the image-receiving layer may include a crosslinkable material which is crosslinked by a borate compound which may be delivered during processing (typically under alkaline conditions, e.g., pH values higher than 9 and often higher than 12) as is described in U.S. Pat. No. 5,593,809 the entire disclosure of which is incorporated by reference herein.

Many materials for use in the polymeric acid-reacting layer, the timing layer and the image-receiving layer are known in the art as are techniques for forming such layers. See, for example, U.S. Pat. No. 5,591,560, the entire disclosure of which is incorporated by reference herein. A preferred polymeric acid-reacting layer 14 comprises a free acid of a copolymer of methyl vinyl ether and maleic anhydride and a vinyl acetate ethylene latex.

Hold-release timing layers are preferred for the film units of the invention. A particularly preferred material for use in timing layer 16 is a pentapolymer of diacetoneacrylamide, butyl acrylate, methyl methacrylate, carbomethoxymethyl acrylate and acrylic acid.

A particularly preferred material for use in image-receiving layer 18 comprises a polyvinyl alcohol binder (crosslinkable) material and a terpolymer mordant material as shown in columns 8 and 9 of U.S. Pat. No. 5,591,560.

Strip-coat layer 20 facilitates the separation of image-receiving element 10*a* from the photosensitive element 30*b* as shown in FIG. 2. For example, in photographic film unit 30 which is processed by distribution of an aqueous alkaline processing composition 34 between the image-receiving element 10*a* and a photoexposed photosensitive element 30*b*, the strip-coat layer 20 serves to facilitate separation of the photograph 10*a* from the developed photosensitive system 36, processing composition layer 34 and support 38 (collectively 30*b*).

Strip-coat layer 20 of the present invention comprises an anion of a homopolymer of acrylic acid complexed with a cationic quaternary salt represented by the formula

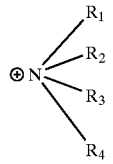

wherein $R_1$–$R_4$ are each independently selected from the group consisting of hydrogen, $C_1$–$C_6$ alkyl and $-(CH_2)_mR_5$ wherein m is 1 or 2 and $R_5$ is phenyl. As mentioned previously, the cationic quaternary salt may have associated with it a photographically-acceptable anion which may be a halogen such as chlorine or bromine or tosylate.

Generally, the strip coat composition comprises a ratio of from about 5:1 to about 1:1 parts by weight of poly(acrylic acid) to the quaternary salt.

In a preferred embodiment the strip coat layer further includes an ethoxylated alcohol represented by the formula $$C_{30}H_{62}—O-(CH_2—CH_2—O)_p-OH$$

where p is an integer of about 40.

The ethoxylated polymer is generally present in an amount of from about 10 to about 40 parts by weight to from about 60 to about 90 parts by weight of poly(acrylic acid) and quaternary salt. A preferred ethoxylated polymer for use according to the invention is available from Baker Petrolite Corp. under-the name Diax P804.

A preferred strip coat layer according to the invention comprises about 73.2 mg/m$^2$ (6.8 mg/ft$^2$) of poly(acrylic acid), about 52 mg/m$^2$ (4.80 mg/ft$^2$) of ammonium chloride and about 18.3 mg/m$^2$ (1.7 mg/ft$^2$) of the ethoxylated polymer. Generally, the thickness of strip-coat layer 20 may vary and preferably is quite thin, i.e. from about 0.10 to about 1.25 $\mu$m (about 0.004 to about 0.05 mils). It is apparent that strip-coat layer 20 should not contain a mordant for the diffusing image dye-providing material and should not be so thick as to serve as an image-receiving layer itself or interfere with the transfer of the image dye-providing material to the underlying image-receiving layer 18. Generally, a strip-coat layer having a total coverage of from about 86.1 mg/m$^2$ (8 mg/ft$^2$) to about 162 mg/m$^2$ (15 mg/ft$^2$) can provide the desired results.

The strip-coat layer described above may be incorporated in various types of image-receiving elements known in the art and the materials and the arrangement and order of the individual layers in such elements may vary.

The advantageous results obtained through the use of the present invention have been observed through extensive experimentation. To further aid those skilled in the art to understand and practice the invention the proposed theoretical mechanism by which these advantageous results are thought to be effected will be discussed, it being understood that the proposed theoretical mechanism is not to be construed as limiting of the invention. It is thought that during photographic processing the poly(acrylic acid), in the presence of the cationic quaternary salt, is neutralized and reacts with the alkaline processing composition in such a way as to facilitate the separation of the image-receiving element from the photosensitive element.

With reference to FIG. 2, a diffusion transfer peel-apart type photograph film unit according to the present invention is generally shown at 30. The film unit 30 includes a photoexposed photosensitive element 30*b* comprising a processing composition layer 34, a developable photosensitive system 36 and an opaque support 38. The film unit 30 is shown after photographic processing and prior to separation of an image-receiving element 10*a* from a processed photosensitive element 30*b*. Prior to processing, the processing composition 34 is typically contained within a pressure-rupturable pod, as is common in the art. Such pods and like structures are common in the art and generally define the means for providing the processing composition between the photosensitive element and image-receiving element. The processing composition typically comprises an aqueous alkaline solution including a developing agent and other addenda as is known in the art. Examples of such processing compositions are found in the following U.S. Patent Nos. and the patents cited therein: U.S. Pat. Nos. 4,756,996; 3,455,685; 3,597,197; 4,680,247 and 5,422,233. As noted previously, the processing composition may include a borate compound capable of crosslinking a crosslinkable material within the image-receiving layer and/or other layer(s), e.g. strip-coat, of the image-receiving element.

It will be noted that strip-coat layer 20 is generally shown as being removed from image-bearing layer 18*a* upon separation of the image-receiving element 10*a* from photosensitive element 30*b* after photographic processing. A thin layer of the strip-coat, however, may adhere to the image-bearing layer, if upon separation, the strip-coat layer fractures with a part of the layer remaining attached to the image-bearing layer and the other part being removed with the photosensitive element.

The photosensitive system 36 comprises a photosensitive silver halide emulsion. In a preferred color embodiment of the invention, the photosensitive silver halide emulsion includes a corresponding diffusible dye, which upon processing is capable of diffusing to the image-receiving layer 18 as a function of exposure. In a preferred "black & white" embodiment of the invention, the image-forming material utilized is complexed silver which diffuses from the photosensitive element to the image-receiving layer during processing. Both such photosensitive systems are well known in the art and will be described in more detail hereinafter.

In further reference to FIG. 2, an image-receiving element 10*a* is generally shown, including layers 12*a*, 12*b*, 14, 16, 18 and 20. More specifically, an image-receiving element 10*a* is shown including a support 12*a*. The support may comprise an opaque support material 12*a*, such as paper, carrying a light-reflecting layer 12*b* thereon. On separation of the image-bearing photograph 10*a*, the image in image-bearing layer 18*a* can be viewed against light-reflecting layer 12*b*. Light-reflecting layer 12*b* can comprise, for example, a polymeric matrix containing a suitable white pigment material, e.g., titanium dioxide.

The image-receiving elements of the present invention are particularly preferred for use in film units intended to provide multicolor dye images. The most commonly employed negative components for forming multicolor images are of the "tripack" structure and contain blue-, green-, and red-sensitive silver halide emulsion layers, each having associated therewith in the same or in a contiguous layer a yellow, a magenta and a cyan image dye-providing material, respectively. Suitable photosensitive elements and their use in the processing of diffusion transfer photographs are well known and are disclosed, for example, in U.S. Pat. No. 3,345,163 (issued Oct. 3, 1967 to E. H. Land, et al.); in U.S. Pat. No. 2,983,606 (issued May 9, 1961 to H. G. Rogers); and in U.S. Pat. No. 4,322,489 (issued Mar. 30, 1982 to E. H. Land, et al.). Photosensitive elements which include dye developers and a dye-providing thiazolidine compound can be used with good results and are described in U.S. Pat. No. 4,740,448 to P. O. Kliem.

It will be apparent that the image-receiving elements of the invention may be used in film units other than those specifically described. For example, the diffusion transfer photographic film unit described in Japanese patent application S61-252685, filed Oct. 23, 1986, is formed by placing a photosensitive element on a white supporting structure which is made up of at least: a) a layer having a neutralizing function; b) a pigment-receiving layer; and c) a peelable layer. The photosensitive element includes at least one silver halide emulsion layer associated with an image dye-providing material, an alkaline developing substance containing a light-shielding agent and a transparent cover sheet. Similarly, the subject invention may also be used in a peel apart film unit as described in U.S. Pat. No. 5,023,163.

The image-receiving element of the present invention is also applicable to black and white photographic film units. In such embodiments, a photosensitive element including a photosensitive silver halide emulsion is exposed to light and subject to an aqueous alkaline solution comprising a silver halide developing agent and a silver halide solvent. The developing agent reduces exposed silver halide to metallic silver and the solvent reacts with un-reduced silver halide to form a soluble silver salt complex. This soluble silver salt complex migrates to an image-receiving element. The image-receiving element typically comprises a support and an image-receiving layer including a silver precipitating material wherein the soluble silver salt complex is precipitated or reduced to form a visible silver "black and white-"image. The binder material for the overcoat layer in black and white embodiments should be permeable to the photographic alkaline processing fluid and to complexed silver salt which transfers to the image-receiving layer to provide an image. Examples of such black and white photographic film units are disclosed in U.S. Pat. Nos. 3,567,442; 3,390,991; and 3,607,269 and in E. H. Land, H. G. Rogers, and V. K. Walworth, in J. M. Sturge, ed., *Neblette's Handbook of Photography and Reprography,* 7th ed., Van Nostrand Reinhold, New York, 1977, pp. 258–330.

As previously stated, the subject image-receiving element is also intended for use within photothermographic film units. Various embodiments of such film products are known and typically comprise: 1) a photosensitive element including at least one photosensitive silver halide emulsion, and with color embodiments, a corresponding image dye providing material, and 2) an image-receiving element including an image receiving material. Typically, the photosensitive element is exposed and subsequently brought in superposed contact with the image-receiving element, wherein the assembly is heated for a predetermined time period. In addition to heating, some applications require a small amount of water to be added to the photosensitive element prior to lamination with the image-receiving element. The application of heat, (and water if used), results in the image-wise diffusion of image materials (e.g. complexed silver in black and white embodiments, image dyes in color embodiments) from the photosensitive element, to the image-receiving element. Subsequently, the image-receiving element is separated from the photosensitive element. Various embodiments of photothermographic film units and processes are described in: S. H. Mervis and V. K. Walworth, *Kirk-Othmer Encyclopedia of Chemical Technology,* 4th. Edition, Volume 6, John Wiley & Sons, Inc. 1993, pp. 1036–1039. Specific examples of such film units are described in U.S. Pat. Nos.: 4,631,251; 4,650,748; 4,656,124; 4,704,345; 4,975,361; and 5,223,387. Typically, image-receiving elements used in photothermographic film units would not include the timing and/or acid-reacting layers as described with reference to the preferred photographic embodiment.

The invention will now be further described with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLES

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

Example I

Diffusion transfer photographic film units A–D according to the invention were prepared wherein the image-receiving element comprised the following layers deposited in succession upon an opaque polyethylene clad paper support:

1. a polymeric acid-reacting layer at a coverage of about 25,609 mg/m$^2$ (2380 mg/ft$^2$), comprising 9 parts GANTREZ S-97 (a free acid of a copolymer of methyl vinyl ether and maleic anhydride available from the GAF Corp.), and 11 parts AIRFLEX 465 (a vinyl acetate ethylene latex available from the Air Products Co.), and about 2% by weight (based on the amount of Gantrez) of hexamethylmethoxymelamine;

2. a timing layer coated at a coverage of 4844 mg/m$^2$ (450 mg/ft$^2$) of a 29/14.9/43/10/3.2 (parts by weight) pentapolymer of butyl acrylate, methyl methacrylate, diacetone acrylamide, carbomethoxymethyl acrylate and acrylic acid;

3. an image-receiving layer coated at a coverage of about 3228 mg/m$^2$ (300 mg/ft$^2$) comprising: 2 parts of a terpolymer comprising the following monomer units:

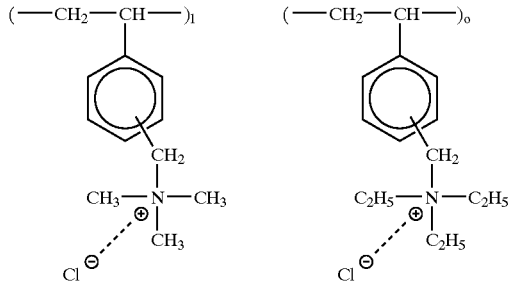

-continued

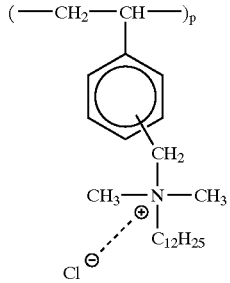

wherein l, o, and p represent the relative molar ratios of each monomer unit and are preferably 0.45, 0.45 and 0.1, respectively; 1 part AIRVOL 523, (a partially hydrolyzed polyvinyl alcohol material available from the Air Products Co.), and 1 part butanediol; and 4. A strip coat layer, as shown in Table I, comprising poly(acrylic acid) and ammonium chloride, either alone or in combination with Diax P804.

TABLE I

| Film Unit | % PAA Ammonium Chloride | % Ethoxylated Polymer |
|---|---|---|
| A | 100 | 0 |
| B | 90 | 10 |
| C | 80 | 20 |
| D | 70 | 30 |

The photosensitive element comprised an opaque subcoated polyethylene terephthalate photographic film base having the following layers coated thereon in succession:

1. a cyan dye developer layer comprising about 771 mg/m$^2$ (8296 mg/ft$^2$) of the cyan dye developer represented by the formula

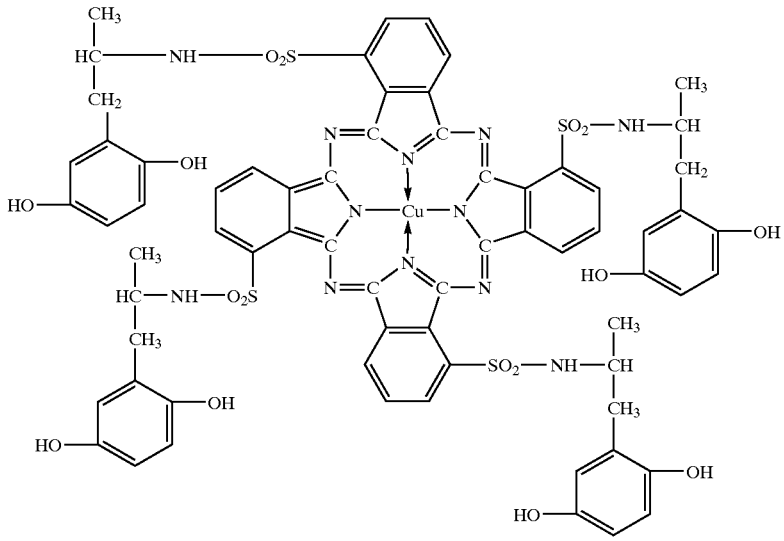

and about 335 mg/m$^2$ (3605 mg/ft$^2$) of gelatin;

2. A spacer layer comprising about 535 mg/m$^2$ (5754 mg/ft$^2$) of a carboxylated styrenebutadiene latex (Dow 620 latex) and about 178 mg/m$^2$ (1915 mg/ft$^2$) of gelatin:;

3. a red-sensitive silver iodobromide layer comprising about 224 mg/m$^2$ (2410 mg/ft$^2$) of silver (0.7 micron), about 785 mg/m$^2$ (8447 mg/ft$^2$) of silver (1.5 microns), about 112 mg/m$^2$ (1205 mg/ft$^2$) of silver (1.8 microns), and about 448 mg/m$^2$ (4820 mg/ft$^2$) of gelatin;

4. an interlayer comprising about 2950 mg/m$^2$ (31742 mg/ft$^2$) of a pentapolymer of butyl acrylate/diacetone acrylamide/methacrylic acid/styrene/acrylic acid, and about 102 mg/m$^2$ (1098 mg/ft$^2$) of polyacrylamide;

5. a magenta dye developer layer comprising about 354 mg/m$^2$ (38098 mg/ft$^2$) of a magenta dye developer represented by the formula

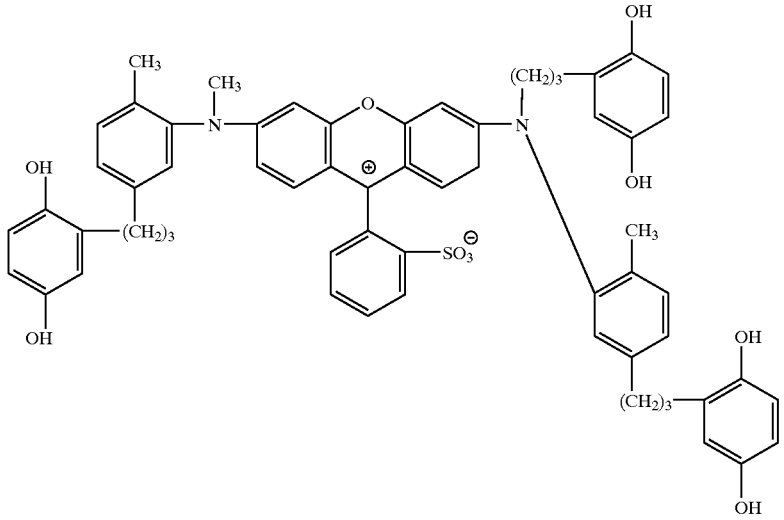

about 415 mg/m$^2$ (4465 mg/ft$^2$) of gelatin, about 350 mg/m$^2$ (3766 mg/ft$^2$) of 2-phenyl benzimidazole, about 40 mg/m$^2$ of phthalocyanine blue filter dye and about 90 mg/m$^2$ (968 mg/ft$^2$) of acetylpyridine-N-oxide;

6. a spacer layer comprising about 333 mg/m$^2$ of carboxylated styrenebutadiene latex (Dow 620 latex) and about 111 mg/m$^2$ of gelatin;

7. a layer comprising about 120 mg/m$^2$ of DAMNHQ, about 108 mg/m$^2$ of gelatin; about 18 mg/m$^2$ of a zinc complex of benzylaminopurine and about 150 mg/m$^2$ of a lactone compound as described at column 9, lines 1–3 of U.S. Pat. No. 5,571,656;

8. a green-sensitive silver iodobromide layer comprising about 315 mg/m$^2$ (3389 mg/ft$^2$) of silver (0.6 micron), about 315 mg/m$^2$ (3389 mg/ft$^2$) of silver (1.1 microns), about 420 mg/m$^2$ of silver (1.3 microns), and about 462 mg/m$^2$ (4971 mg/ft$^2$) of gelatin;

9. an interlayer comprising about 1424 mg/m$^2$ (1532 mg/ft$^2$) of the pentapolymer described in layer 4 and about 59 mg/m$^2$ (635 mg/m$^2$) of polyacrylamide;

10. a layer comprising about 1140 mg/m$^2$ (1227 mg/ft$^2$) of a scavenger, 1-octadecyl-4,4-dimethyl-2-[2-hydroxy-5-(N-(7-caprolactamido)sulfonamido] thiazolidine and about 428 mg/m$^2$ (4616 mg/ft$^2$) of gelatin;

11. a yellow filter layer comprising about 320 mg/m$^2$ (3443 mg/ft$^2$) of benzidine yellow dye, about 160 mg/m$^2$ (1722 g/ft$^2$) of a hardener (OB 1207 find name) and about 125 mg/m$^2$ (1345 mg/ft$^2$) of gelatin;

12. a yellow image dye-providing layer comprising about 855 mg/m$^2$ (9200 mg/ft$^2$) of a yellow image dye-providing material represented by the formula

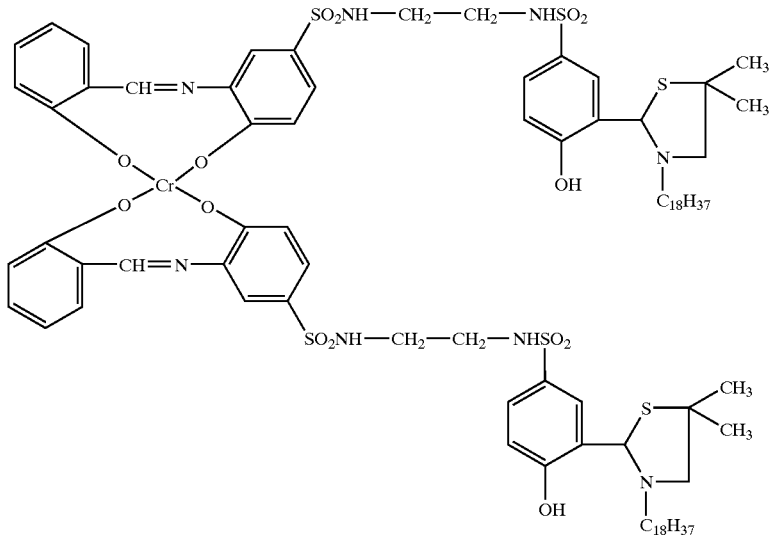

and about 342 mg/m$^2$ (3680 mg/ft$^2$) of gelatin;

13. a layer comprising about 427 mg/m$^2$ (4594 mg/ft$^2$) of norbornenyl tertiarybutyl hydroquinone, about 427 mg/m$^2$ (4594 mg/ft$^2$) of a complex of dimethylamide and terephthalic acid; and about 342 mg/m$^2$ (3680 mg/ft$^2$) of gelatin;

14. a blue-sensitive silver iodobromide layer comprising about 71 mg/m$^2$ (764 mg/ft$^2$) of silver (1.2 microns), about 214 mg/m$^2$ (2303 mg/f$^2$) of silver (2.1 microns) and about 114 mg/m$^2$ (1227 mg/ft$^2$) of gelatin;

15. a layer comprising about 200 mg/m$^2$ (2152 mg/ft$^2$) of an ultraviolet filter, Tinuvin (Ciba-Geigy), about 50 mg/m$^2$ (538 mg/ft$^2$) of benzidine yellow dye, about 238 mg/m$^2$ (2561 mg/ft$^2$) of pheny tertiarybutyl hydroquinone and about 180 mg/m$^2$ (1937 mg/ft$^2$) of gelatin; and 16. a layer comprising about 500 mg/m$^2$ (5380 mg/ft$^2$ of Tinuvan and about 200 mg/m$^2$ (2152 mg/ft$^2$) of gelatin.

The film units were processed with an aqueous alkaline processing composition described in Table II.

TABLE II

| Component | Parts by Weight |
|---|---|
| Potassium hydroxide | 7.16 |
| Hydroxy PMT (parahydroxyphenyl mercapto tetrazole) | 0.004 |
| 1-ethyl-5,6,7,8-tetrahydroquinolinium tosylate | 0.69 |
| 1-methylimidazole | 0.24 |
| 1,2,4-triazole | 0.32 |
| Hypoxanthine | 0.90 |
| PMT (phenyl mercapto tetrazole) | 0.003 |
| 6-benzylamino purine | 0.025 |
| Guanine | 0.15 |
| Boric acid | 0.35 |
| 5-amino-1-pentanol | 1.51 |
| Hydrophobically modified hydroxyethylcellulose (Natrosol Plus$^{tm}$ available from Aqualon) | 3.12 |
| Sodium salt of paratoluene sulfinic acid | 1.0 |
| Titanium dioxide | 0.083 |
| 6-methyl uracil | 0.45 |
| Benzyl trimethyl ammonium chloride | 0.57 |
| Water | Balance to 100 |

The film units were processed by bringing the photosensitive element into superposed relationship with the image-receiving element and passing the combination through a pair of pressure rollers having a gap spacing of about 0.0036" so as to rupture a rupturable container containing the aqueous alkaline processing composition and affixed between the respective elements so as to distribute the processing composition between the respective elements. After an imbibition period of 90 seconds the photosensitive and image-receiving elements were separated from each other.

For each film unit there was a clean separation of the image receiving element from the photosensitive element.

The film units were tested for red green and blue image densities. The results are shown in Table III.

TABLE III

| Film Unit | R | G | B |
|---|---|---|---|
| | | Dmax | |
| A | 2.14 | 2.23 | 1.69 |
| B | 2.08 | 2.22 | 1.65 |
| C | 2.14 | 2.25 | 1.70 |
| D | 2.02 | 2.10 | 1.65 |
| | | Dmin | |
| A | 0.15 | 0.14 | 0.10 |
| B | 0.14 | 0.13 | 0.10 |
| C | 0.15 | 0.14 | 0.10 |
| D | 0.14 | 0.13 | 0.10 |

It can be seen that the film units gave acceptable photographic prints.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

What is claimed is:

1. An image-receiving element for use in a photographic or photothermographic diffusion transfer process comprising in sequence:

a support;

an image-receiving layer; and a strip-coat layer overlying said image-receiving layer, said strip-coat layer comprising an anion of a poly (acrylic acid) represented by the formula

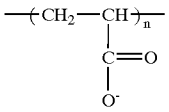

(I)

where n is an integer of from about 65 to about 3500 complexed with a cationic quaternary salt represented by the formula

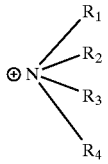

wherein $R_1$–$R_4$ are each independently selected from the group consisting of hydrogen, $C_1$–$C_6$ alkyl and $-(CH_2)_m R_5$, wherein m is 1 or 2 and $R_5$ is phenyl; and an ethoxylated polymer represented by the formula $$C_{30}H_{62}—O-(CH_2—CH_2—O)_p-OH$$

where p is an integer of about 40.

2. The image-receiving element as defined in claim 1 wherein said anion of poly(acrylic acid) has a molecular weight of from about 5,000 to about 500,000.

3. The image-receiving element as defined in claim 2 wherein said anion of poly(acrylic acid) has a molecular weight of about 50,000.

4. The image-receiving element as defined in claim 1 wherein said strip coat comprises from about 5:1 to about 1:1 parts by weight of said anion of poly(acrylic acid) to said quaternary salt.

5. The image-receiving element as defined in claim 1 wherein said quaternary salt is ammonium chloride.

6. The image-receiving element as defined in claim 1 wherein said strip coat comprises from about 10 to about 40 parts by weight of said ethoxylated polymer and from about 60 to about 90 parts by weight of said anion of poly(acrylic acid) and said quaternary salt.

7. The image-receiving element as defined in claim 1 wherein said strip coat comprises an anion of poly(acrylic acid), ammonium chloride and said ethoxylated polymer.

8. A diffusion transfer film unit adapted for use in photographic and photothermographic processes, said film unit comprising:

a photosensitive element comprising a support carrying at least one silver halide emulsion layer; and an image-receiving element as defined in claim 1 adapted to be separated from said photosensitive element following photoexposure and photographic processing.

9. The diffusion transfer film unit as defined in claim 8 wherein said anion of poly(acrylic acid) has a molecular weight of from about 5,000 to about 500,000.

10. The diffusion transfer film as defined in claim 9 wherein said anion of poly(acrylic acid) has a molecular weight of about 50,000.

11. The diffusion transfer film unit as defined in claim 8 wherein said strip coat comprises from about 5:1 to about 1:1 parts by weight of said anion of poly(acrylic acid) to said quaternary salt.

12. The diffusion transfer film unit as defined in claim 8 wherein said quaternary salt is ammonium chloride.

13. The diffusion transfer film unit as defined in claim 8 wherein said strip coat comprises from about 10 to about 40 parts by weight of said ethoxylated polymer and from about 60 to about 90 parts by weight of said anion of poly(acrylic acid) and said quaternary salt.

14. The diffusion transfer film unit as defined in claim 8 wherein said strip coat comprises said anion of poly(acrylic acid), ammonium chloride and said ethoxylated polymer.

* * * * *